US007986801B2

(12) United States Patent
Schobben et al.

(10) Patent No.: US 7,986,801 B2
(45) Date of Patent: Jul. 26, 2011

(54) DEVICE HAVING A POINT AND A SPATIAL SOUND GENERATING-MEANS FOR PROVIDING STEREO SOUND SENSATION OVER A LARGE AREA

(75) Inventors: Daniel Willem Elisabeth Schobben, Eindhoven (NL); Martinus Hermanus Wilhelmus Maria Van Delden, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 822 days.

(21) Appl. No.: 10/597,150

(22) PCT Filed: Jan. 3, 2005

(86) PCT No.: PCT/IB2005/050006

§ 371 (c)(1),
(2), (4) Date: Jul. 13, 2006

(87) PCT Pub. No.: WO2005/072011

PCT Pub. Date: Aug. 4, 2005

(65) Prior Publication Data

US 2008/0253591 A1 Oct. 16, 2008

(30) Foreign Application Priority Data

Jan. 19, 2004 (EP) ..... 04100145

(51) Int. Cl.
*H04R 5/02* (2006.01)
*H04R 5/00* (2006.01)

(52) U.S. Cl. ..... 381/300; 381/1; 381/17

(58) Field of Classification Search ..... 381/300–309, 381/1, 17–19
See application file for complete search history.

(56) References Cited

U.S. PATENT DOCUMENTS

| | | | | | |
|---|---|---|---|---|---|
| 4,778,027 | A | * | 10/1988 | Taylor | 181/175 |
| 4,819,269 | A | * | 4/1989 | Klayman | 381/307 |
| 5,784,468 | A | * | 7/1998 | Klayman | 381/300 |
| 5,943,430 | A | * | 8/1999 | Saitoh | 381/160 |
| 6,154,549 | A | * | 11/2000 | Arnold et al. | 381/104 |
| 2003/0219137 | A1 | | 11/2003 | Fincham | |

FOREIGN PATENT DOCUMENTS

| | | |
|---|---|---|
| EP | 0847225 A2 | 6/1998 |
| WO | 8912373 | 12/1989 |

* cited by examiner

*Primary Examiner* — Devona E Faulk

(57) ABSTRACT

A device is described, having a first (2) and a second (4) sound-generating means and an input for a stereo signal (S) comprising left (L) and right (R) sound signals. The device has an interconnected first (1) and second (3) part comprising a first (2) and a second (4) sound-generating means, respectively. The first part (1) is formed so as to couple soundwaves generated by the first sound-generating means (2) into a surface (6) when placed upon said surface (6), and the device has means (5) for sending a first signal (S1), which is a composite of the left (L) and right (R) sound signals, to the first sound-generating means (2) of the first part (1), and a second signal (S2), which is a different composite of the left (L) and right (R) sound signals, to the second sound generating means (4) of the second part (3).

16 Claims, 4 Drawing Sheets

DEVICE HAVING A POINT AND A SPATIAL SOUND GENERATING-MEANS FOR PROVIDING STEREO SOUND SENSATION OVER A LARGE AREA

FIELD OF THE INVENTION

The invention relates to a device having a first and a second sound-generating means and an input for a stereo signal comprising left and right sound signals.

BACKGROUND OF THE INVENTION

Devices comprising two sound-generating means are known and widely used.

Spatial localization of sound has always been considered to be of paramount importance in audio reproduction devices. Contemporary sound reproduction devices are required to have at least stereo playback capabilities, and two or more loudspeakers are conventionally provided for such facilities. This usually results in devices with external loudspeakers separated from each other by a considerable distance and the associated footprint and wiring issues. However, this requires a space with enough distance between the loudspeakers, which is not always available and often also requires wiring. In many circumstances, more compact devices would be preferred. However, although such compact devices have been developed and sold, the stereo playback of these devices such as 'ghettoblasters' is not perceived as true stereo playback because the loudspeakers are spaced very close to each other. Some stereo-widening techniques such as Philips' "Incredible Surround" are known and overcome such limitations to some extent. However, such techniques may typically reduce the "sweet spot" (i.e. the area in which a good or acceptable stereo sound is produced), which sometimes becomes impractically small since consumers typically do not sit exactly in front of such a sound device. Furthermore, such techniques are usually complicated. Typically, compact devices for producing stereo sound have the drawback that, although they do provide stereo sound only in or near the sweet spot, the positions in which this is achieved is limited to usually a rather small area right in front of the device. For true stereo sound perception, it is highly preferred that the stereo sound perception remains when a listener walks around or, when more than one person is listening to the sound, all listeners are provided with substantially the same quality of sound. The stereo signal has a left and a right sound signal. The denotations "left" and "right" are understood to merely indicate one of the usual sub-signals of a stereo signal (wherein "stereo signal" may be any multi-channel signal). Unless specifically described otherwise, these denotations are not understood to be anything else but such a simple division of the stereo signal using common terms, and not an undue restriction. In a simple embodiment, however, "left" and "right" stand for the usual "left" and "right" stereo channels.

Thus there is a need for a device that is capable of giving a stereo sound sensation to the listener over a relatively large area while yet being a, preferably very, compact sound reproduction device.

OBJECT AND SUMMARY OF THE INVENTION

It is an object of the invention to provide a compact sound reproduction device capable of giving a stereo sound sensation over a relatively large area.

To this end, the device in accordance with a first aspect of the invention is characterized in that it has an interconnected first and second part comprising a first and a second sound-generating means, respectively, the first part being formed so as to couple soundwaves generated by the first sound-generating means into a surface when placed upon said surface, and wherein the device has means for sending a signal, which is a composite of the left and right sound signals, to the first sound-generating means of the first part, and a signal, which is a different composite of the left and right sound signals, to the second sound-generating means of the second part.

The invention is based on the following recognition.

Stereo music typically has a left and a right channel (L, R). The inventors have realized that by forming the first part in such a way that the soundwaves are effectively coupled into a surface on which the first part may be placed, e.g. a table, said object on which the first part is placed will be excited and vibrate with the sound generated by the first part. Due to the large size of the vibrating object, the first signal, which is a composite of the left and right sound signal, is perceived as a "volume sound". Another signal, also a composite of the left and right sound signal, but a different one, is sent to the second part, which basically acts as a point source. Wherever the listener is seated around the table, the sound from both sources, however, sounds the same. The result is that the sound perception is the same all around the device. There is not one sweet spot. The inventors have found that a surprisingly good stereo perception can be obtained. The signals sent to the first and the second part are different, since the inventors have found that certain sounds attribute more to the volume sound effect than others.

More in particular, for preferred embodiments, the first signal sent to the first part and the second signal sent to the second part are, in operation, substantially orthogonal signals, i.e. when the first signal is expressed as $S1=aL+bR$, and the second signal as $S2=cL+dR$, where L and R are the left and right sound signal, respectively, the product $(ac+bd)$ is on average substantially zero, at least less than 0.1, preferably less than 0.05, wherein most preferably the absolute values of a and c are approximately (within twenty to ten percent) the same, as are the absolute values of b and d.

In a preferred embodiment, the first signal is mainly comprised of a difference of the left and right stereo sound signals $(L-R)$ and the second signal sent to the second part, and the point source is mainly comprised of a sum signal of the left and right stereo sound $(L+R)$. In another preferred embodiment, the signals may be analyzed to find a dominant signal $(aL+bR)$, and the device has means for sending a dominant signal and the residual signal. Most music comprises signals that are present in both stereo signals, typically, for instance, a singer or a solo artist. The sound produced by the solo artist is usually the dominant signal, and usually the solo artist stands in the middle, i.e. the intensities for the sound produced by the solo artist are the same in the left and the right sound signal. Summing the stereo signals $(L+R)$ and sending the sum $(L+R)$ to the second sound-generating means will lead to the solo artist being heard as if he were present at the position of the second part, i.e. a localized source for the singer or solo artist is established. The sound produced by this localized source is perceived substantially the same around the source. The sounds that give a stereo impression to the music are typically present at either the left or the right signal or at least much more in one channel than in the other. Sending the difference signal $(L-R)$ to the first sound-generating means would in itself not necessarily give a sufficient stereo sound impression, since both the first part (L−R source) and the second part (L+R source) would generate sound at a single point, where usually these points are close to one another for a compact device. This would lead to the same problems as described above for existing devices. In the device according to the invention, it is possible, in operation, to effectively couple this sound via the first part into a surface on which the first part may be placed, e.g. a table, whereby said object on which the first part is placed will be excited and vibrate with the sound generated by the first part. The result is that the table or other object co-vibrating with the second part forms a spatially extended source generating the difference signal (L−R). Wherever the listener is seated around the table, the sound from both sources sounds the same. The combination of a localized source for one composite signal, preferably the dominant signal, for instance, the sum signal (the second part L+R) and a spatial source for another composite signal, preferably the residual signal, for instance, for the difference signal (L−R) (the first part in combination with a vibrating, excited, surface) produces a stereo sound impression all around. The electronics for the present device are very simple, the device itself may thus be very compact. Yet a stereo sound impression is achieved which does not require the listener to be positioned in a particular spot or area. Use of a sum and a difference signal is a preferred embodiment.

The invention makes use of the possibility to vibrate a large rigid object, for example a table top, by means of a much smaller primary source, such that it produces a larger sound than the sound originating from the primary source if sufficient acoustical coupling is ensured. Depending on the properties of the object to be excited and the acoustical coupling, the sound intensity of the larger object is larger and richer than that of the primary source (the first sound-generating means) alone, presumably because of the much larger surface area of the table when compared to the primary source. In this application, this phenomenon is also called co-vibration or co-excitation.

Within the concept of the invention, the device is made to be such that a table vibrates when the first part is positioned on the table or another co-vibrating object. Such effects always occur to some extent. However, normally, each loudspeaker box is made to minimize such an effect as much as possible, in other words, co-vibration is counteracted or minimized as much as possible. In conventional designs, the loudspeakers do not or hardly make contact with the table. They are usually suspended in an enclosure which, in fact, comprises a good vibration damper or functions as such. However, in contrast, the co-vibrating effect is an integral part of the present invention. Measures are described hereinafter to distinguish devices according to the invention from those beyond its scope.

The first part of the device and the first sound-generating means are arranged in such a way that, when the first part is positioned on a table top as defined in this application, the sound volume produced by said first part at a distance of 1 meter from said first part is increased by at least 6 dB as compared to the same part when used in air. Simply picking up the first part will therefore distinguish those devices within and beyond the scope of the present invention. The device is laid on a wooden (plywood) table top having a thickness of 18 mm and a size of 90*180 cm, more or less corresponding to a standard office table, and a force corresponding to a weight of 100 grams is applied to the device while laying flat on the table, with the display parallel to the table, and the increase of sound intensity is measured at a distance of 1 meter with respect to the same device when in air, i.e. lying on wool. The 100 grams include the force applied by the device itself In many circumstances, this will be approximately the weight of the first part itself.

The manner in which the increase of sound intensity is measured is defined in this application.

The first part preferably comprises a coupling means. Using a coupling means, i.e. a means for enhancing mechanical coupling, very substantial increases of sound intensity of the first sound-generating means, above 15 dB, or even above 20 dB are possible. Such means may e.g. be suction means or magnets. Suction means will effectively increase the force by means with which the device sticks to the table (enhancing its apparent weight), while magnets will enhance its apparent weight when put on a steel surface. Both may be present.

The mechanical coupler is preferably formed in such a way that it extends slightly beyond the first means proper so that, when the first means is positioned on the table or other flat surface, the first means rests on the mechanical coupler. The mechanical coupler itself does not have much influence on the sound intensity of the device when hand-held.

Due to excitation of the object on which the first part is placed, a much richer and better audible sound is obtained.

The standard test with which the increase can be measured will be explained in the description of the Figures. Basically, the increase of sound volume is measured at a distance of 1 meter, while the device is placed on a wooden table of 18 mm thickness and 90*180 cm size, while the total weight of the device plus additional pressure exceeds 100 grams.

In preferred embodiments, the device is provided with a sound-recording element and the device comprises a means for establishing a comparison between a registered sound and an emitted sound signal and means to indicate that the device is in co-excitation with another object and to regulate the sound intensity of the first means accordingly. It is not known in advance on what surface the first means will be positioned. Thus, the effective sound intensity may vary, depending on the table on which the first means is positioned. By providing a microphone, and a feedback of the actual sound intensity, some means for regulating the sound intensity in effect produced by the first means is possible.

In preferred embodiments, the second sound-generating means is positioned on a swivel, i.e. a means for changing the direction of the sound produced by the second sound-generating means. Such a swivel (which, within the scope of the invention, comprises any means for changing the position or direction of the second sound-generating means vis-à-vis the first, while yet maintaining a physical connection) may e.g. be used advantageously to direct the sound in one general direction.

In another related aspect of the invention, the device comprises an interconnected first and second part comprising a first and a second sound-generating means, respectively, the first part being formed so as to couple soundwaves generated by the first sound-generating means into an outer envelope of the first part, and wherein the device has means for sending a first signal, which is a composite of the left and right sound signals, to the first sound-generating means of the first part, and a second signal, which is a different composite of the left and right sound signals, to the second sound-generating means.

In a further related aspect of the invention, the device comprises an interconnected first and second part comprising a first and a second sound-generating means, respectively, the first part being formed so as to couple soundwaves generated by the first sound-generating means into an elongated element coupled to the first part, and wherein the device has means for sending a signal, which is a composite of the left and right sound signals, to the first sound-generating means of the first part, and a signal, which is a different composite of the left and right sound signals, to the second sound-generating means.

The inventors have realized that a similar advantage may be obtained by using either an outer envelope of the first part as a co-vibrating object, or an elongated element (i.e. an object having a dimension which is larger than the dimension of the first part itself).

These and other objects of the invention are apparent from and will be elucidated with reference to the embodiments described hereinafter.

BRIEF DESCRIPTION OF THE DRAWINGS

In the drawings.

The Figures are not drawn to scale. Generally, identical components are denoted by the same reference numerals in the Figures.

DESCRIPTION OF EMBODIMENTS

Figure 1:
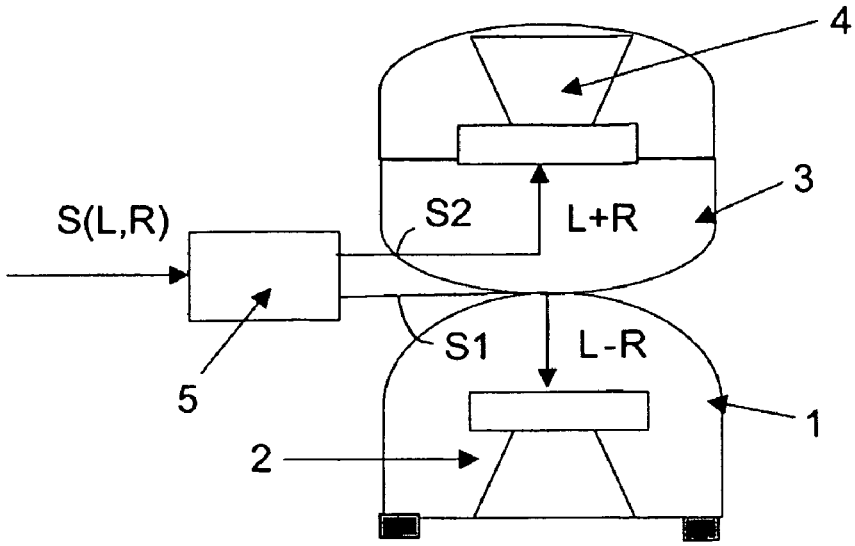
FIG. 1 illustrates schematically a device according to the invention

FIG. 1 schematically shows a compact stereo device according to the invention.

The stereo device has an input for an incoming stereo signal S comprising a left (L) and a right (R) signal, and an interconnected first (1) and second part (3) comprising a first (2) and a second (4) sound-generating means, respectively. The first part 1 is formed so as to couple soundwaves generated by the first sound-generating means into a surface when placed upon this surface. Basically, in this example, soundwaves are effectively coupled with the housing and via the housing with, for instance, a table top or directly into the table top. Normally, sound-generating means are positioned inside loudspeakers so that they are decoupled with the housing and the outside world as much as possible. In the first part, the opposite effect is sought, a large coupling is present to the outer envelope, to an elongated element or to a surface upon which the first part is placed. The device has means 5 for sending a composite signal S2 (L+R), comprising in this example a sum signal of the first (L) and second (R) stereo signals, to the second sound-generating means (4) of the second part (2), and another, different composite signal S1 (L−R), comprising in this example a difference signal of incoming first (L) and second (R) stereo signals, to the first sound-generating means (2) of the first part (1). The composite signals are preferably orthogonal signals, i.e. when the first signal S1=aL+bR and the second signal S2=cL+dR, then $ac+bd\approx 0$. Using a sum and a difference signal is a simple embodiment. The device may have means for establishing a dominant signal, and send it to the second part (the "point-source"), and send the residual signal (a signal orthogonal to the dominant signal) to the first means (the "spatial source").

In simple designs, the different composites S1, S2 of the signals may be the same throughout the frequency range. In more complex embodiments, the values a, b, c and may differ for different frequency ranges. In an embodiment, for instance, the first and the second part may receive the same signal for a lower frequency range up to the cut-off frequency, e.g. up to 300 or 500 Hz, and orthogonal signals at all frequencies above the cut-off frequency.

The first sound-generating means (2) of the first part (1) may be, and in preferred embodiments is, a piezo-element, which is so positioned that, when the device is placed on a surface, the piezo-element rests on this surface. In this manner, vibrations are effectively coupled into the surface. A piezo-element is a preferred element for the first part because piezo-elements have such a form and function that they are well suited to couple soundwaves into a surface. The second sound-generating means (4) of the second part (2) may be a squeeter. The means 5 may be attached to the first and the second part forming a unit. In such embodiments, the unit receives the signal S and the sum and the difference signal are generated in situ, i.e. in the unit. In other embodiments, the means 5 is separate from the first and the second part. For instance, there may be one central processing unit (such as a CD-player) and several sound units, wherein a means 5 is provided at the central processing unit for providing the signals, which are then wirelessly sent to the units.

Figure 2:
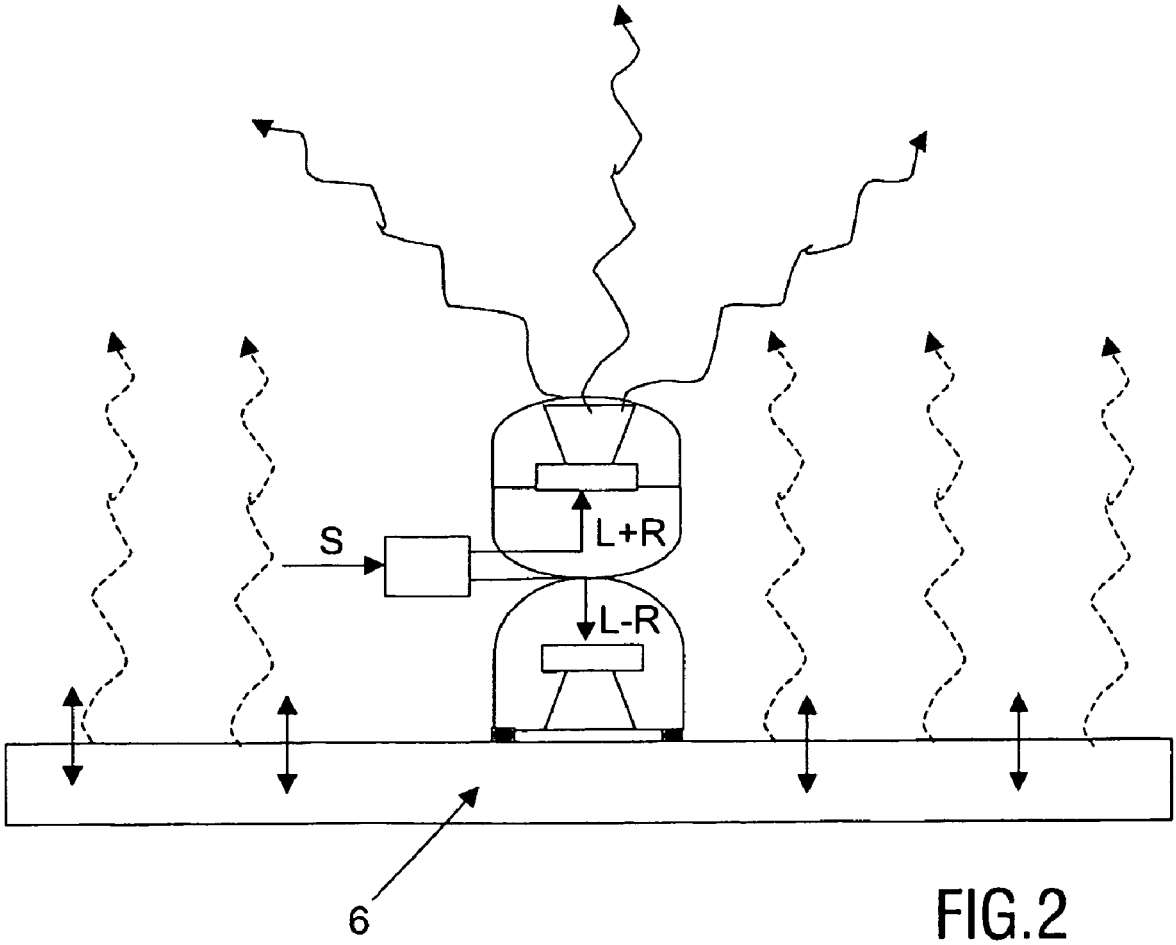
FIG. 2 illustrates the basic concept of the invention.

FIG. 2 illustrates the basic concept of the invention in the first aspect. The invention is based on the recognition that it is possible to vibrate a large rigid object, for example, a table top 6, by means of a much smaller primary source (first sound-generating means 2), such that it produces a larger sound than the sound originating from the primary source if sufficient acoustical coupling is ensured. Depending on the properties of the object to be excited and the acoustical coupling, the sound intensity of the larger object is larger and richer than that of the primary source (the first sound-generating means) alone, presumably because of the much larger surface area of the table when compared to the primary source. Thus, even a lower frequency sound can be produced, even though the excitation amplitude of the table is much smaller (a few nm) than that of the primary source itself (several microns to tens of microns). In order for this to be achieved, a positive, sufficiently large acoustical coupling between the sound-generating means and the larger object needs to be established. In this application, this phenomenon is also indicated by the words co-vibration and/or co-excitation. FIG. 2 illustrates schematically that the second sound-generating means produce a sound which originates more or less from a single point, whereas due to the co-vibration of the table top, illustrated by the vertical arrows, an extended sound source, illustrated by the arrows emanating from the element 6, is created.

Sending the sum (L+R), or in another preferred embodiment, the dominant signal, to the second sound-generating means (4) will lead to the solo artist being heard as if he were present at the position of the second part, i.e. a localized source for the singer or solo artist. The sound produced by this localized source is perceived as being substantially the same all around the source. The sounds that give a stereo impression to the music are typically present at either the left or the right signal, or at least much more in one channel than in the other, or in the residual signal, or in anti-phase, or decorrelated. Sending the difference signal (L−R), or the residual signal, to the first sound-generating means (2) would in itself not necessarily give a sufficient stereo sound impression, since both the first part (L+R-source) and the second part (L−R source) would generate sound at a single point, where, for a compact device, these points are usually close to one another. In the device according to the invention, the sound-waves, when positioned on a surface, are effectively coupled into a surface on which the first part is placed, e.g. a table. The object on which the first part is placed will vibrate with the sound generated by the first part. The result is that the table or another object itself forms a spatially extended source, as illustrated in FIG. 2 reproducing the difference signal (L−R). Wherever the listener is seated around the table or object in general, the sound from both sources sounds the same. The combination of a localized source for the sum signal (the second part) and a spatial source for the difference signal (the first part in combination with a vibrating surface) produces a stereo sound impression. This stereo sound impression is substantially the same around the co-vibrating object. The electronics are very simple, as is the device, which itself may thus be very compact. A stereo sound impression is achieved which does not require the listener to be positioned in a particular spot. It is to be noted that where mention is made of the "sum" and the "difference" signal, this is meant to express that the signal sent is mainly comprised of the sum and/or difference signal.

Figure 3A:
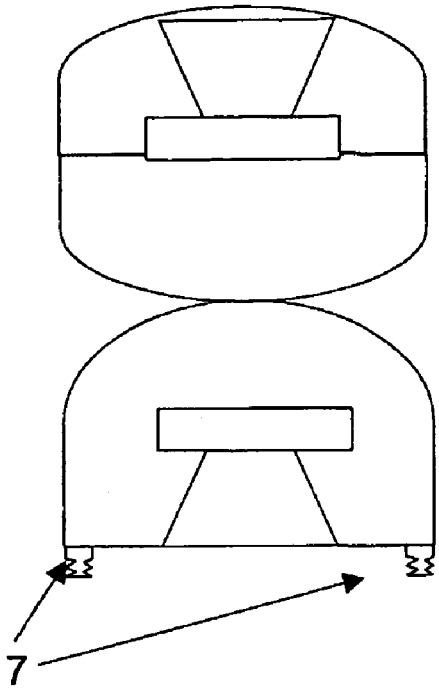
FIGS. 3A and 3B illustrate schematically further embodiments of a device according to the invention.
Figure 3B:
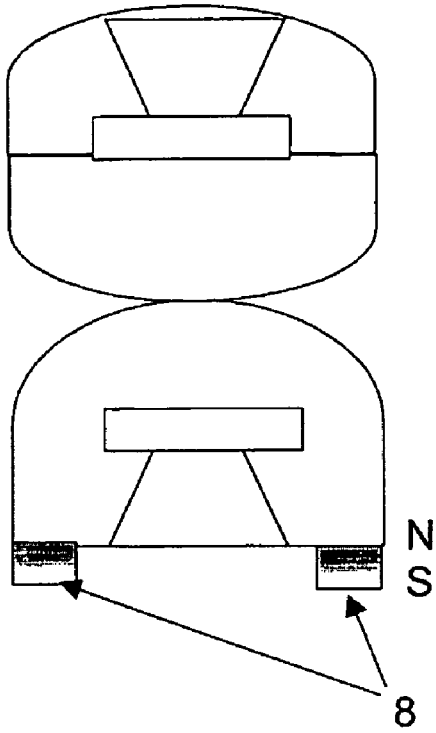

FIGS. 3A and 3B illustrate a further embodiment of a device according to the invention. The device comprises a coupling means 7, 8 for coupling the first part of the device to a surface. Such a coupler may be, for instance, a suction device 7. Some suction force will increase the coupling between the device and the surface. The coupling means may also be in the form of magnets 8. Provision of such magnets will increase the coupling upon a steel surface. The coupling means may combine both functions, for instance, when suction devices with magnets enclosed are used.

Figure 4:
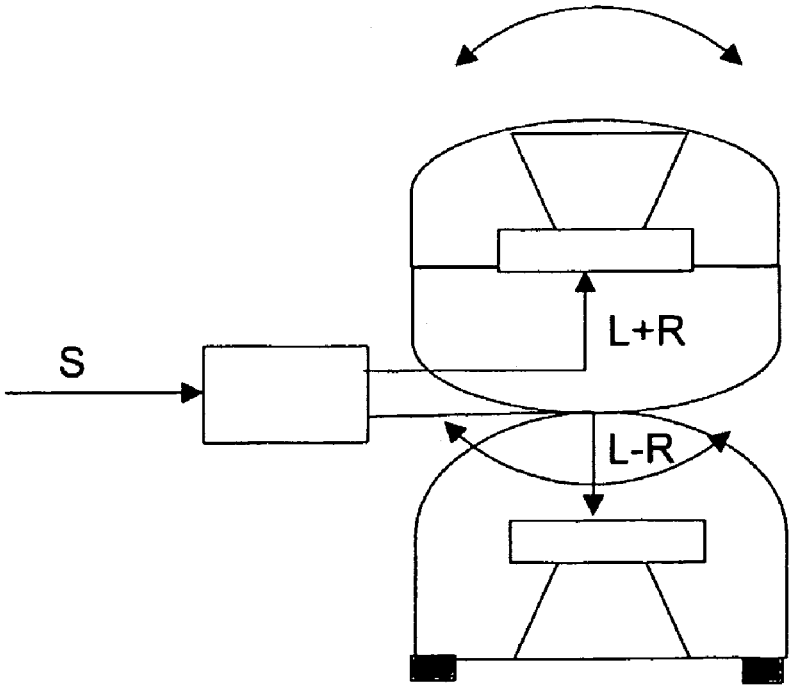
FIG. 4 illustrates schematically yet a further embodiment of a device according to the invention.

FIG. 4 illustrates a further embodiment. In this embodiment, the first and the second part are interconnected in such manner that the first part may be moved and oriented with respect to the second part. Some directionality in the second sound source may thereby be imparted.

Figure 5:
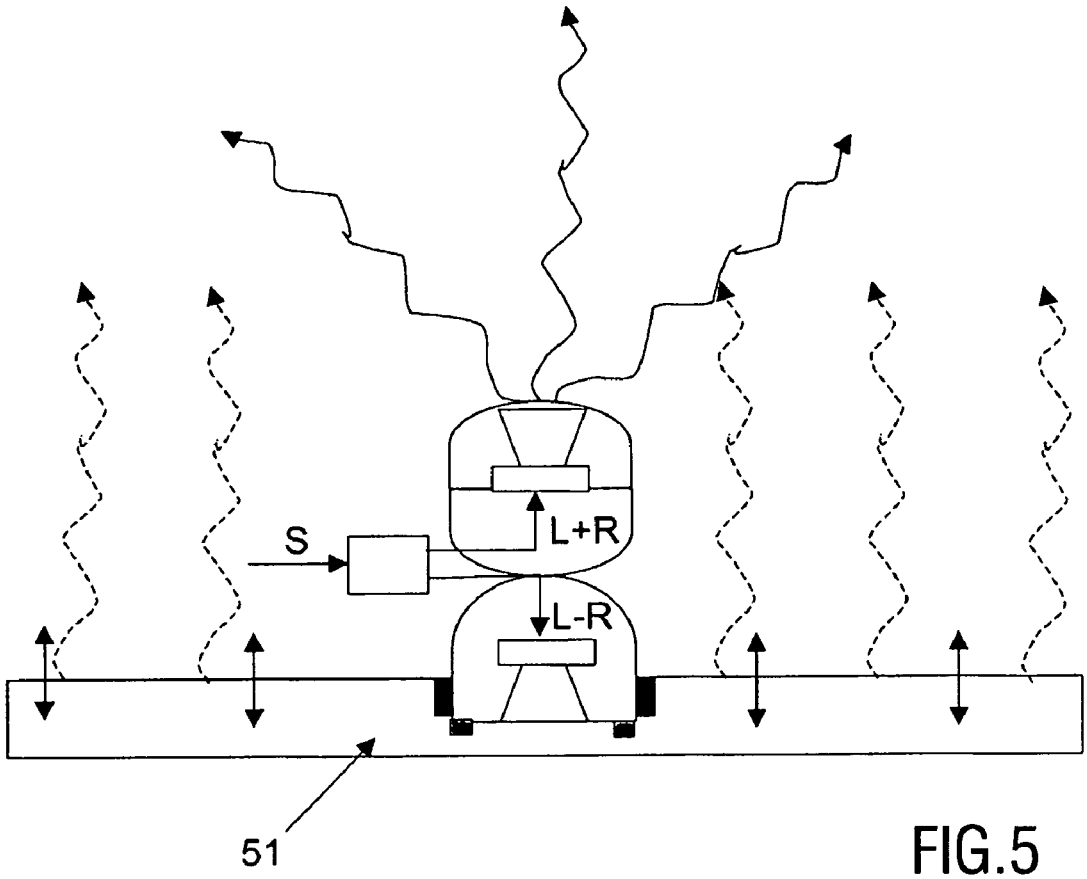
FIG. 5 illustrates a device according to the invention, including a sound co-vibration element.

FIG. 5 illustrates another aspect of the invention in which the device itself comprises a co-vibrating element 51. In embodiments, such as in the previous Figures, the unit of first and second sound-generating means will be placed on a table to produce stereo sound. In the embodiment of FIG. 5, the device itself comprises the vibrating means. An example of such a means is a table 51 which comprises a built-in first and second part. This may be in the form of a unit comprising a first and a second part, and an extended element, wherein the extended element and the unit comprise fastening means to mechanically fasten the unit and the extended element. In a preferred embodiment, the fastening means are reversible, i.e. the unit may be decoupled from the extended element. This would allow decoupling of the unit and placing it on another element or e.g. a table. A further example of a device similar to the one shown in FIG. 5 would be an overhead set, wherein the extended element would be part of, or parallel to, the ceiling. The sound would then come from above. The advantages of a device that has a co-vibrating element built in (be it the outer envelope of the first part or an elongated element to which the first part is coupled) is that the coupling is known.

Figure 6:
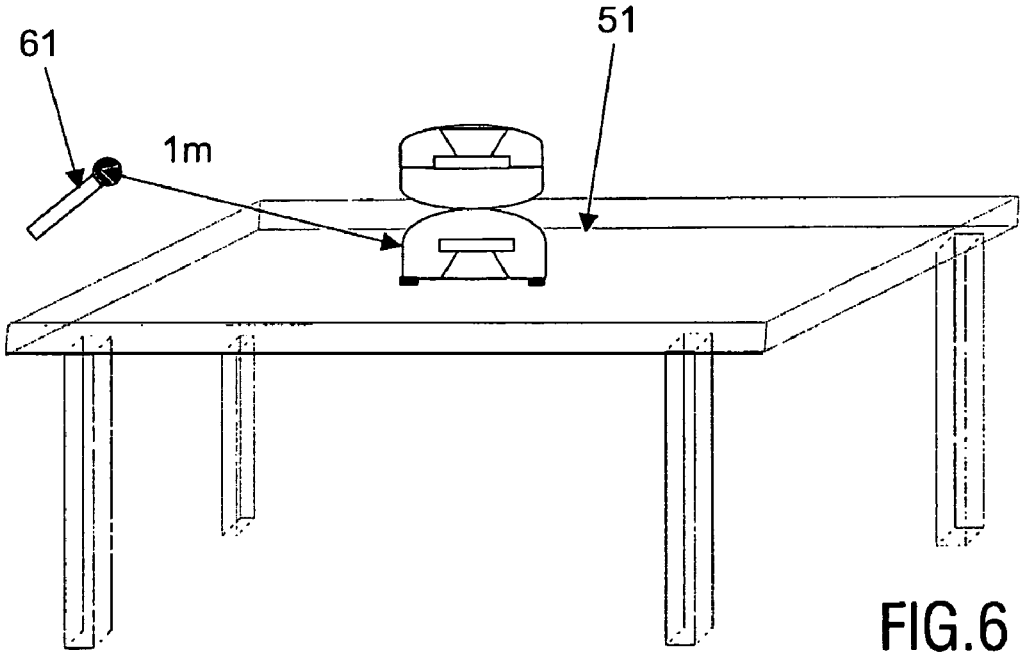
FIG. 6 illustrates the experimental set-up for measuring sound enhancement by acoustical coupling.

FIG. 6 schematically indicates the manner in which the sound increase is measurable. The device 1 is positioned on a table 51 in the proper orientation and, if it has a coupling means 7, 8, with the coupling means on the table, and if the device has a suction cup, with suction action.

The sound level at 1 m distance is measured at frequencies of 1 and 2 kHz, while the first part receives a signal at mid-range of the dynamical range of the first part. The device is removed from the table and placed on a woolen cloth or suspended in air. The sound level is again measured, using, of course, the same signal and the same distance and orientation of the sound-recording means and device. If the increase of the sound level for said frequencies is more than 6 dB, the device falls within the scope of the claim. If not, it falls outside the claim. The increase is preferably at least 15 dB, more preferably at least 20 dB. The table has a wooden (plywood) table top of 90*180 cm with a thickness of 18 mm. This corresponds more or less to a standard table top in offices.

In the standard test, a table having a plywood table top of 18 mm and a size of 90*180 cm is used. However, this is merely for the purpose of establishing a bench mark. Experiments have shown that, when this is the case, very similar results are obtained e.g. when a table of 14 mm plywood and size 160*80 cm is used or when it has a steel table top and a size of 100*200 mm.

The standard of the plywood table having the specified measures is used to establish a frame of reference, while the values for other types of table tops are roughly similar.

It is to be noted that, within the concept of the invention, the device is made in such a way that a table vibrates when the first part is positioned on a table or other co-vibrating object. Such effects always occur to some extent. However, normally, each loudspeaker box is made to minimize such effects as much as possible, in other words, co-vibration is counteracted or minimized as much as possible. In conventional designs, the loudspeakers do not or hardly make contact with the table. They are usually suspended in an enclosure which, in fact, comprises a very good vibration damper or functions as such. In contrast, the effect of co-vibration is an integral part in the present invention. The measurement described above, which can easily be performed by any person skilled in the art, clearly distinguishes devices according to the invention from those outside its scope. For a device into which an elongated element is built (as in FIG. 5), the contribution to the sound of the vibrating element is easily measurable by measuring the sound produced by the device when a signal is sent to the first part, and then by measuring again while clamping down the element (so that it cannot vibrate, a heavy weight could, for instance, be put on the element) and subsequently by dividing the two measurements by dividing the intensities. If it is more than 6 dB, preferably more than 15 dB, the device is a device according to the invention. When the outer envelope of the first part forms the co-vibrating element, a similar test may be performed, in which a signal is sent to the first part in normal operation and mid-range, the sound intensities are measured, subsequently the outer envelope is clamped down so that it cannot vibrate, the sound intensities are measured again, and the measured sound intensities are divided.

Figure 7:
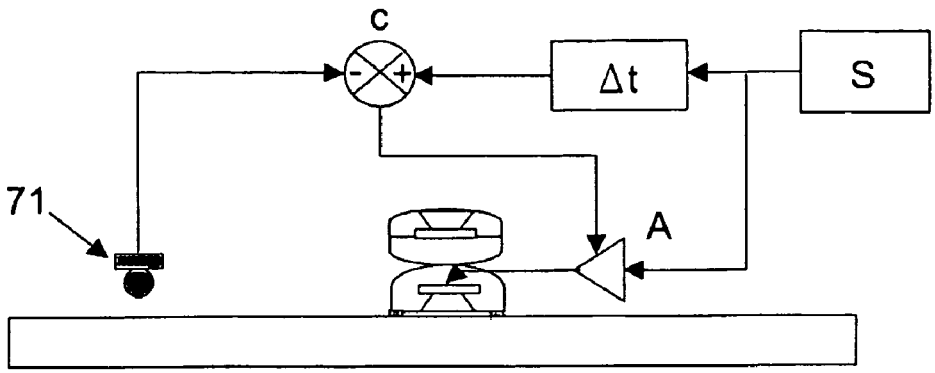
FIG. 7 illustrates a further embodiment of a device according to the invention.

FIG. 7 illustrates a preferred embodiment of the invention. The co-vibrating surface may change the frequency distribution of the sound, since certain frequencies may be more amplified than others. FIG. 7 illustrates a device comprising a sound-recording means 71, which records the sound generated. In comparator C, this sound is compared with the original sound (slightly delayed in time, to account for the time difference). The measured difference in intensity and e.g. frequency distribution of intensity, is fed back to amplifier A to change the signal to the sound-generating means, such that the end result is that the recorded sound corresponds to the original signal, of course within measuring accuracy. It is to be noted that in that case the signal fed to first sound-generating means will be equivalent to L−R, but not exactly the same, thus illustrating an example of the circumstances, as already mentioned above that, where mention is made of a sum or difference of a signal being sent to the first (second) sound-generating means, such is meant to indicate the general content of the signal, but should not be interpreted so restrictively as to be purely the sum or difference signal.

In the embodiments shown, the first part and the second part are interconnected. In a preferred embodiment, this means that they are physically interconnected, in which the two parts form an integral unit. However, this does not mean that the unit may not comprise means for decoupling the first and the second part. In embodiments, this may be advantageous, e.g. because this would make it possible to provide the second means above a table and the first means on a table. However, the two parts would still form a unit in the sense that they are interconnectable to form one unit, and that the signals are coupled.

Figure 8:
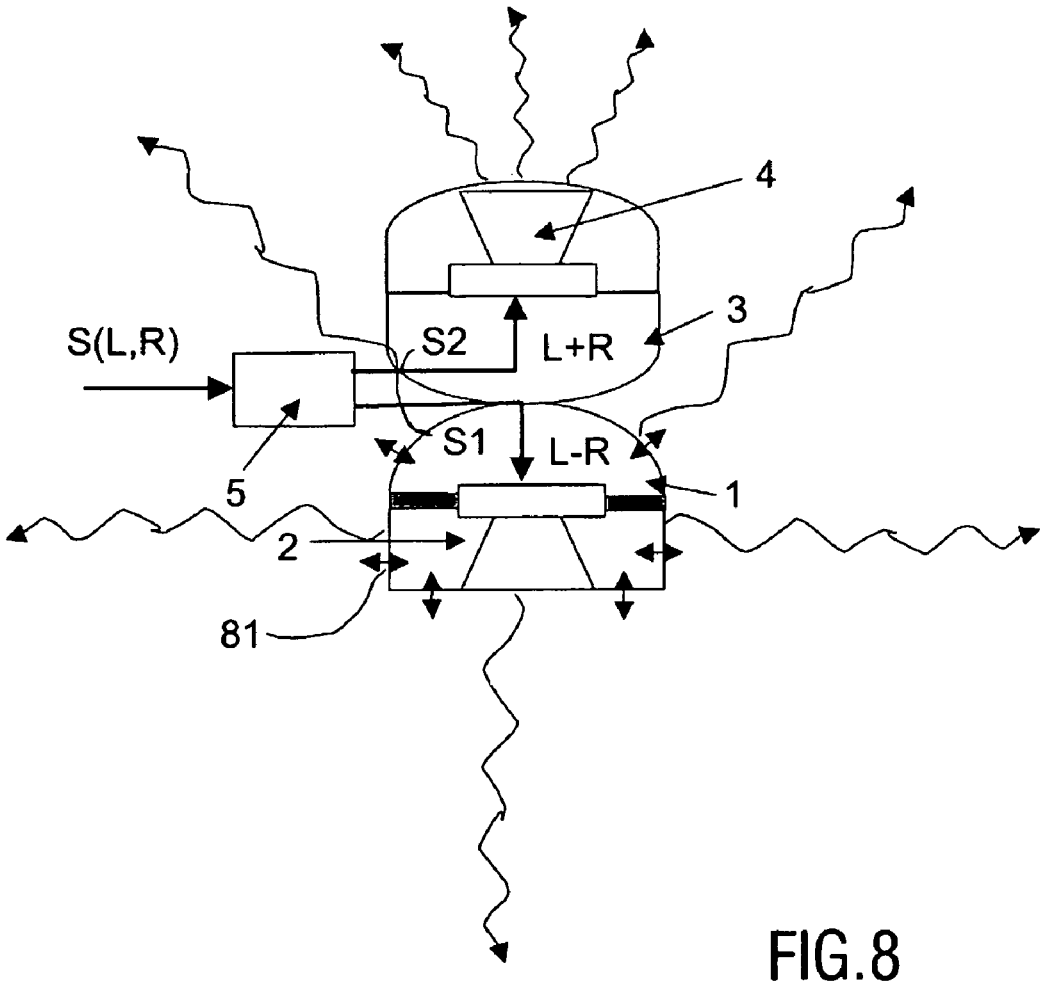
FIG. 8 illustrates a further embodiment according to the invention.

FIG. 8 illustrates an embodiment in accordance with another aspect of the invention, in which the first part comprises a first sound-generating means which is coupled to an outer envelope (housing) 81 of the first part. The outer envelope functions as a spatial source.

It will be evident that many variations are possible within the framework of the invention. It will be appreciated by persons skilled in the art that the present invention is not limited by what has been particularly shown and described hereinbefore. The invention resides in each and every novel characteristic feature and each and every combination of characteristic features. Reference numerals in the claims do not limit their protective scope. Use of the verb "to comprise" and its conjugations does not exclude the presence of elements other than those stated in the claims. Use of the article "a" or "an" preceding an element does not exclude the presence of a plurality of such elements.

It is to be noted with reference to the claims that various characteristic features defined in the set of claims may occur in combination.

The invention claimed is:

1. A device having a first and a second sound-generating means and an input for a stereo signal comprising left and right sound signals, wherein the device has an interconnected first and second part comprising the first and the second sound-generating means, respectively, the first part being physically connected to the second part, the first part being formed so as to couple soundwaves generated by the first sound-generating means into a surface when said device is placed upon said surface, wherein coupling soundwaves into the surface results in a co-vibrating of (i) the first sound-generating means and (ii) the surface to form (iii) a spatially extended source, and wherein the device has means for sending a first signal, being a first composite of the left and right sound signals, to the first sound-generating means of the first part, and a second signal, being a second composite of the left and right sound signals different from said first composite, to the second sound-generating means of the second part, wherein responsive to the co-vibrating of the first sound-generating means and the surface, a sound volume produced by said first part and said surface at a distance of one (i) meter from said first part is increased by at least 6 dB as compared to a sound volume produced by the first part when used in air and not coupled to said surface, and wherein, due to the soundwaves from the spatially extended source of the first sound-generating means and the surface, and the soundwaves from the second sound-generating means, the device provides a stereo sound sensation over a large area.

2. The device as claimed in claim 1, wherein the means for sending is arranged in such a way that the first signal and the second signal are substantially orthogonal signals.

3. The device as claimed in claim 2, wherein the means for sending is arranged in such a way that the first signal comprises a difference signal of the left and right stereo signals, and the second signal comprises a sum signal of the left and right stereo signals.

4. The device as claimed in claim 1, wherein the first part comprises coupling means for coupling the first part to the surface.

5. The device as claimed in claim 4, wherein the coupling means comprises a suction element.

6. The device as claimed in claim 4, wherein the coupling means comprises a magnet.

7. The device as claimed in claim 1, wherein the first sound-generating means comprises a piezo-element.

8. The device as claimed in claim 1, wherein the second sound-generating means comprises a localized source for producing sound that is perceived substantially the same around the localized source.

9. The device as claimed in claim 8, wherein the first and second signals comprise residual and dominant signals, respectively, and wherein a combination of the localized source and the spatially extended source produce a stereo impression all around.

10. The device as claimed in claim 1, further wherein the sound volume is increased by at least 15 dB when the first part is coupled to the surface.

11. The device as claimed in claim 1, further wherein the sound volume is increased by at least 20 dB when the first part is coupled to the surface.

12. The device as claimed in claim 1, wherein the second sound-generating means is positioned on a swivel for changing a direction of the sound produced by the second sound-generating means vis-à-vis the first sound-generating means.

13. The device as claimed in claim 1, wherein the surface comprises a surface of an elongated element.

14. The device as claimed in claim 13, wherein the elongated element comprises an object having a dimension which is larger than a corresponding dimension of the first part.

15. The device as claimed in claim 13, wherein the first part and the elongated element are coupled by reversible coupling means.

16. The device as claimed in claim 1, wherein the surface comprises an outer envelope of the first part, and wherein the outer envelope is configured to operate as a co-vibrating object.

* * * * *